United States Patent [19]

Hue et al.

[11] 4,185,404

[45] Jan. 29, 1980

[54] NODULE DREDGING BUCKET

[75] Inventors: Jean-Pierre Hue; Christian Charles; François Le Foll, all of Brest, France

[73] Assignee: Centre National Pour l'Exploitation des Oceans (CNEXO), Paris, France

[21] Appl. No.: 835,314

[22] Filed: Sep. 21, 1977

[30] Foreign Application Priority Data

Sep. 21, 1976 [FR] France ..... 76 28291

[51] Int. Cl.[2] ..... E02F 5/00

[52] U.S. Cl. ..... 37/71; 37/69; 37/DIG. 8

[58] Field of Search ..... 37/69, 71, DIG. 8, 55; 299/8, 9

[56] References Cited

U.S. PATENT DOCUMENTS

| | | | |
|---|---|---|---|
| 3,084,309 | 4/1963 | Wiegardt, Jr. | 37/71 X |
| 3,120,714 | 2/1964 | Goodwin | 37/55 UX |
| 3,365,823 | 1/1968 | Vogt | 37/71 |
| 3,367,048 | 2/1968 | Doughty | 37/55 |
| 3,561,150 | 2/1971 | Silchenstedt | 37/55 X |
| 3,608,217 | 9/1971 | Voisin, Sr. | 37/55 |
| 3,768,571 | 10/1973 | Renfroe | 37/71 X |
| 3,889,403 | 6/1975 | Gauthier et al. | 37/69 |
| 4,052,800 | 10/1977 | Fuhrboter et al. | 37/DIG. 8 X |

*Primary Examiner*—Clifford D. Crowder

*Attorney, Agent, or Firm*—Fleit & Jacobson

[57] ABSTRACT

A bucket using a box-like parallel-sided basket open at the front for dredging the sea bottom to collect nodules. The basket has a bottom wall with front and rear cross-bars and a plurality of parallel spaced rods extending longitudinally of the basket between the front and rear cross-bars. A front part of the bottom wall includes a grill formed by a transverse front link supporting one end of a plurality of longitudinal spaced flexible elements which are inclined downwardly towards the front and stretched between the front cross-bar and the transverse front link. Large shoes are positioned on lateral sides of the basket for supporting the bucket on the sea bottom. The grill is situated between the shoes with the transverse front link positioned in such manner that it penetrates the sea bottom. The basket is positioned inside the shoes and extends to the external edges of the shoes. The shoes include brackets for connecting a dredging line to the bucket.

16 Claims, 4 Drawing Figures

FIG. 1
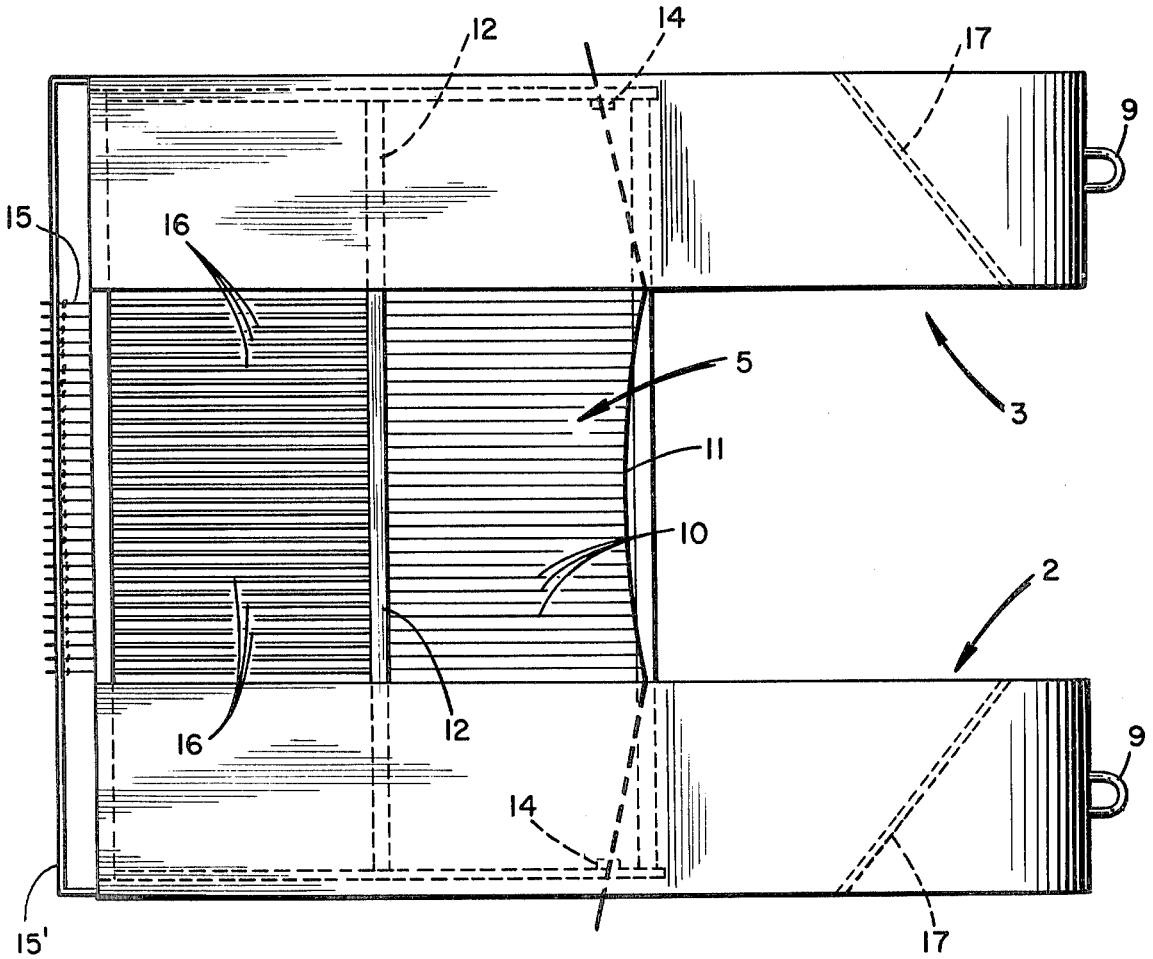
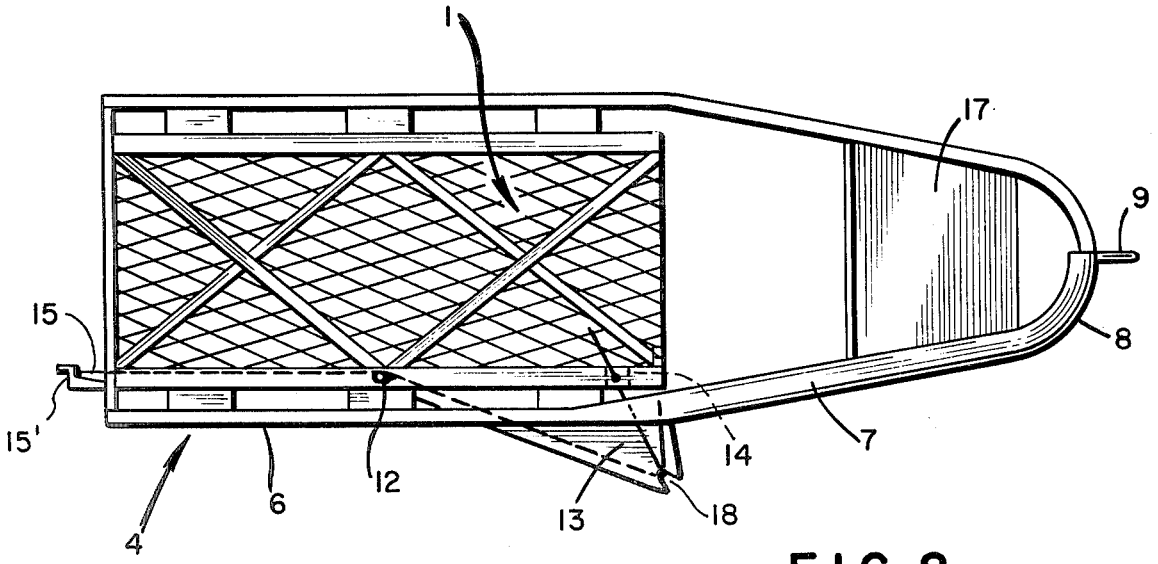
FIG. 2

NODULE DREDGING BUCKET

The present invention concerns a dredging bucket which is particularly able to be placed on an endless line for dredging the sea bottom, such as those used in the process for continuously extracting the sediment described in French Pat. No. 2,185,747.

Such an endless line fitted with buckets is taken down from a ship onto the sea bottom, is brought up on board of another ship where the buckets are emptied and joins again the first ship through a partially immersed portion, both ships moving in the same direction along substantially parallel paths; because of that, the working portion of the dredging line lies at a short distance from the sea bottom or on the bottom, and the buckets which it is fitted with lie down on this bottom: in this way they can collect the sediments. During the collecting operation, the buckets are moving under the action of a force resulting, on one hand from the movement of the dredging line and on the other hand from the passage of the ship.

Among the sediments which are accumulated over the course of time on the ocean bottom, several are the object of systematic research because of their economic value, particularly polymetallic nodules which are concretions containing especially iron, manganese, copper, nickel and cobalt, and which are on the surface and/or in the superficial layer of the sea bottom.

In order for these polymetallic nodules to be collected, it is desirable that each bucket picks up substantially only those bodies to the exclusion of all other sediments. In the course of the picking up, the buckets have to do a screening between the nodules and the sea sediments. In order that the bucket should collect as many nodules as possible, it is necessary that it remains in close touch with the sea bottom as long as the working of the dredging line is continuing in the vicinity of the bottom.

Thus, the buckets have to pick up, screen and store the nodules in order to raise them up to the ship. This triple function is presently performed by buckets comprising a parallelepipedic basket opening in the front and the floor of which is extended forward by teeth slightly inclined downwards.

Such buckets have many disadvantages. In particular, the proportion of polymetallic nodules which are collected is too low with respect to the other sediments, i.e. the filling up coefficient, ratio between the weight of recuperated nodules and the total weight of raised materials, is too low. Besides, it has been noticed that a serious tamping may occur in front of the bucket teeth, which causes the bucket to come off from the sea bottom, often preceded by a forward rocking motion of the bucket; such movements cannot be allowed because they occasion, every time, a partial, or even complete, loss of what has been collected in the bucket basket, and also because the bucket picks up the nodules in a non-repeating way.

Thus, one object of the present invention is to provide a bucket particularly able to be placed on an endless dredging line of the type described in French Pat. No. 2,185,747 ensuring the collection of polymetallic nodules with a high filling-up coefficient.

One object of the present invention is to provide a bucket of this type which is as stable as possible in its motions of displacement on the sea bottom during the complete stage of collecting nodules.

A further object is to provide such a bucket which can pick up nodules in amounts as repetitive as possible.

In the following specification, it will be supposed that the dredging bucket lies on a plane, horizontal surface and is directed in its own direction of movement, so as to give an accurate meaning to the expressions such as "front", "back" and "lateral" which will be met in the following.

These objects will be understood from the following description, and are achieved by the dredging bucket according to the present invention, which comprises, in combination, a basket of roughly parallelepipedic shape, open at the front, which is fitted with lateral shoes and the floor of which embodies at the front part a grill with longitudinal elements downwardly inclined and the front end of which only penetrates the bottom to be dredged, wherein the elements of the grill are flexible and are stretched between a transverse front link and an element integral with the front edge of the horizontal part of the floor of the basket.

Preferably, these flexible elements are fixed at one end on the transverse front link, passed onto the element integral with the front edge of the basket front part and, at the other end, are mounted to the back part of the basket by means of stretchers.

Advantageously, the flexible elements are constituted by steel wires.

The transverse front link is preferably a deformable link each end of which is anchored on an element integral with the corresponding lateral face of the basket.

Advantageously, the deformable link passes at each side of the grill before joining the corresponding anchoring element, onto a groove cut in a cheek fixed to the basket.

The grill is inclined downwardly at an angle of between 10 and 25 degrees, and preferably in the vicinity of 20 degrees. Its length must be, of course, such that its front end is beneath the surface of the sediment layer on which the dredging bucket is placed. The value of this angle is easy to determine as a function of the geometric parameters of the system and, especially as a function of the inclination of the grill and of the sea bottom clearance of the basket.

In particular, each of these lateral shoes is constituted by a continuous structure surrounding the corresponding lateral wall of the basket; this structure comprises a sole which extends under the basket and essentially along its complete length, which is turned up at the front so as to form an inclined plane and which is prolonged by an upwardly rounded portion, which is itself prolonged backwards, over the basket and behind it, by elements joined to the back part of the sole. The inclined plane constitutes with the horizontal an angle advantageously comprised between 5 and 20 degrees, preferably in the vicinity of 10 degrees.

As for the sea bottom clearance, it must be noticed that the floor of the basket is preferably located at a vertical distance of about ten centimeters above the sole of the lateral shoes.

Advantageously, the dredging bucket comprises means for adjusting this vertical distance.

In particular, the upper side of the basket comprises towards its front an upwardly inclined grill identical with the one of the floor of this basket, and the upper side of said shoes includes a sole similar to that of the lower side.

Preferably, at least a part of the basket floor is constituted by longitudinal rods, so as to facilitate the backward motion of the nodules.

Advantageously, the basket, the width of which can be greater than its length, can be laterally extended to the external edge of the lateral shoes and downwardly inside these shoes: that increases the storage volume and distributes it in a more convenient way especially with regard to the bucket stability.

Advantageously, the foremost part of each of these lateral shoes is fitted with a vertical deflecting plate placed obliquely in such a way that the two deflecting plates converge to the bucket front.

As for the means for hooking on the dredging line, they are preferably located on the rounded part of the shoes.

The following non-limitative description will provide a better understanding of how the present invention can be put into practice. Reference will be made to the accompanying drawing, wherein:

FIG. 1 shows an upper view of a dredging bucket according to the invention,

FIG. 2 shows a side view, and

Figure 3:
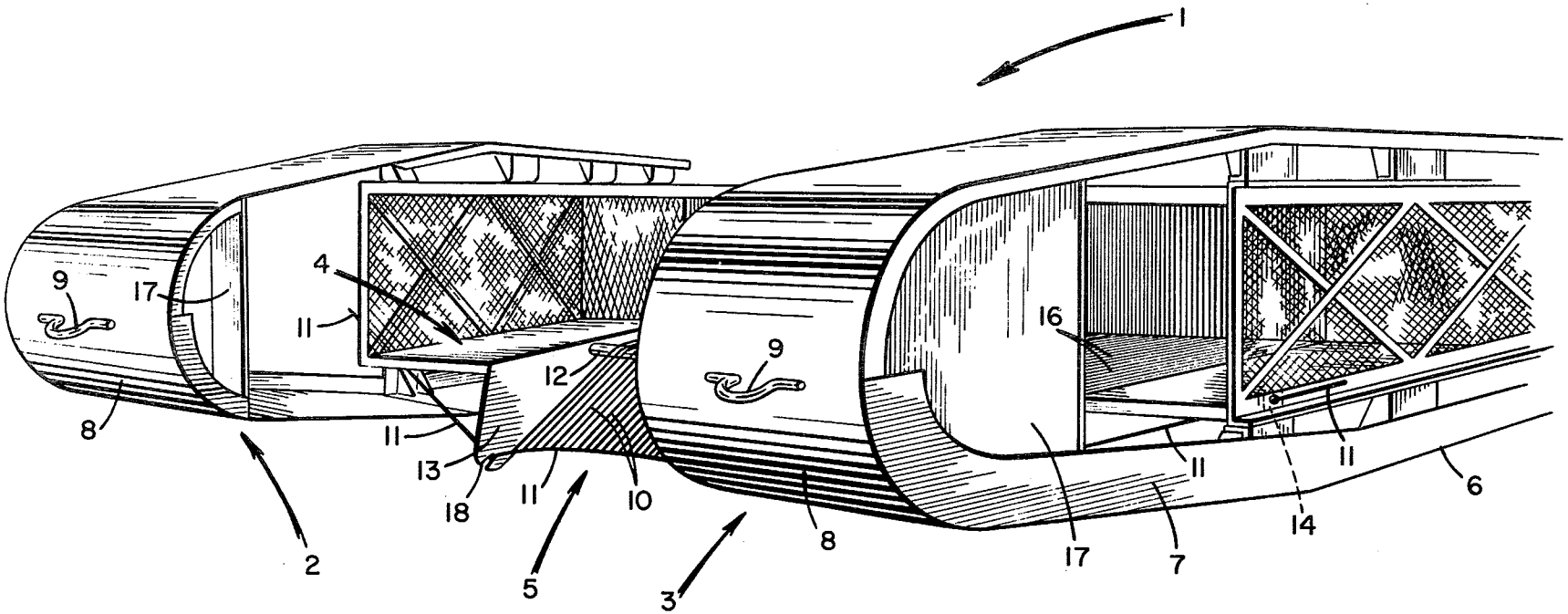
FIG. 3 shows a perspective view.

As seen from FIG. 1, a dredging bucket according to one embodiment of the invention essentially comprises a basket 1 of roughly parallelepipedic shape which is fitted with lateral shoes, indicated in their entirety by the references 2 and 3, and the floor 4 of which comprises at the front a zone 5 slightly downwardly inclined which has a grill structure and which will hereinafter be described in more detail.

The lateral shoes, as seen in sideview in FIG. 2, have a continuous band, the inner face of which comprises a horizontal sole 6, placed at right angles to the basket, which is raised at the front to form an inclined plane 7, the front face of which is upwardly rounded at the front. To the fronts of the shoes are fixed means 9 for hooking the bucket to the dredging line; these means can be, e.g. rings or ring-bows. The angle of the inclination of the inclined plane 7 of the shoe footings is between 5 and 20 degrees and preferably has a value near to 10 degrees.

The bearing area of the shoes must be such that the depth to which the bucket dredges into the sediment is minimal, i.e. between 0 and 5 centimeters. For a given area, this depth is a function of (a) the weight of the bucket and of the load of the collected materials, and (b) of the particular features of the sea bottom and, especially of its cohesion. These features are determined according to known methods, by means of samples collected on the sea bottom; from the results of such determinations those skilled in the art are able to determine the bearing area to be given to the shoes in each particular case.

The floor 4 of the basket includes a front grill 5 (see FIG. 1) placed between the shoes and slightly downwardly inclined. This grill 5 is constituted by longitudinal flexible elements 10 stretched between a link 11 at the front and the back part of the floor, passing onto the element or front cross-bar 12 which constitutes the front edge of the horizontal floor part 4.

This link 11, which may be for example a round bar, a cable, a steel wire of the piano wire type or a small chain, passes in notches 18 made in vertical cheeks 13 which are fixed to the basket 1, the ends of this link being anchored in blocks 14 also fixed to the basket.

Advantageously, the longitudinal flexible elements 10 are fixed to the back part of the basket by means of stretchers 15 on a rear cross-bar 15'. These flexible stretched elements 10 confer on the inclined front zone 5 a grill structure.

As flexible elements 10 there may be used for example cables, steel wire of the piano wire type, or round bars of small diameter. The fixing of each flexible element 10 on the link 11 at one end and to a stretcher at the other end, is effected by any suitable means. When such an element 10 is constituted of piano wire, it is possible to bend its ends in the form of a hair pin and pass one around the link 11 and the other in the stretcher 15.

The spacing between two consecutive flexible elements 10 is a function of the nodule size: it has to be, of course, lower than the smallest size of the nodules which are desired to be picked up.

The angle formed to the horizontal line by the grill 5 must be such that, on one hand the nodules can pass up into the basket and, on the other hand the flexible elements 10 fulfill their function of screening and of picking up without being submitted to too much restraint. This is why this angle must be between 10 and 25 degrees; it is preferably close to 20 degrees.

The floor 4 of the basket 1 is constituted by round bars 16 arranged parallel to the shoes, so as to assist the movement of the nodules towards the rear of the basket: there must be between each bar a small space, which is less than the smallest dimension of the nodules. The other faces of the basket can be constituted by a lattice of metal strips or by any similar structure, except for the front face which must be open.

In order to confer a high stability on the bucket, it is necessary, in addition to the already mentioned conditions, that the basket 1 fitted with its grill 5 extends longitudinally along about the two rear thirds of the total length of the apparatus.

The floor 4 of the basket must always be over the sea bottom, whatever the sinking of the shoes in the sediment. In order to reach this result whatever the nature of the sediment constituting the sea bottom, the floor 4 is placed about 10 centimeters above the soles of the shoes.

The basket may be mounted in such a way that the distance between the basket floor and the shoe sole 6 may be adjusted.

The emptying of the basket is effected by rocking it forward. This is why it is advantageous to provide in the space inside the front part of each shoe which embodies the inclined plane 7, an oblique deflective sheet 17, which during the emptying, prevents accumulation of the nodules inside the round part 8 of the shoe.

Figure 4:
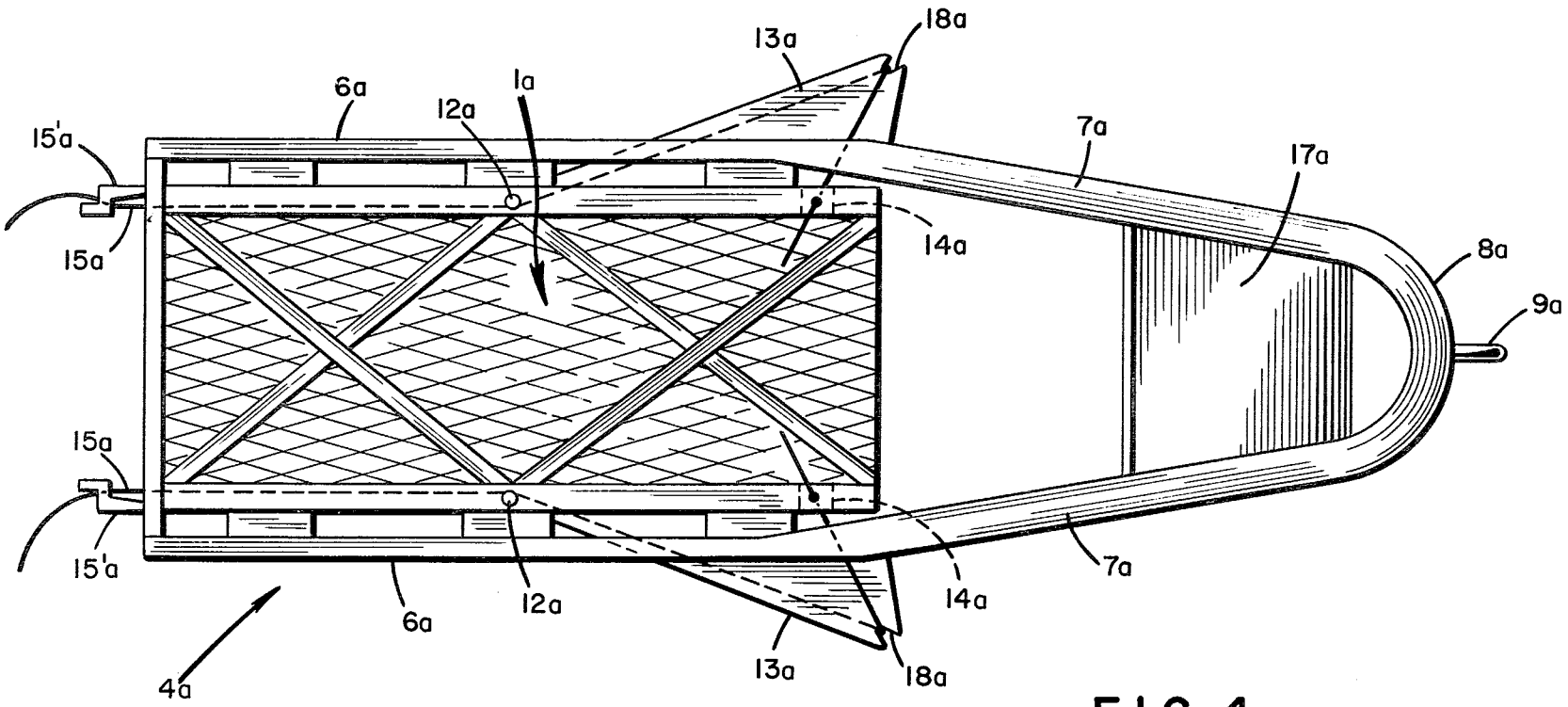
FIG. 4 shows a side view of another embodiment.

The bucket is preferably constructed symmetrically (as shown in FIG. 2) with regard to a median horizontal plane; this allows the bucket to always fall on the sea bottom in a working position. With the embodiment illustrated in FIG. 4, the same reference numerals, followed by the suffix "a" have been used to identify elements similar to those already discussed in connection with the embodiment illustrated in FIGS. 1 to 3. Thus, FIG. 4 illustrates a dredging bucket having a basket, generally designated 1*a*, fitted with upper and lower lateral shoes on both sides, and upper and lower floors, generally designated 4*a*. In a like manner, elements 6*a*, 7*a*, 8*a*, 9*a*, 12*a*, 13*a*, 14*a*, 15*a*, 15'*a*, 17*a*, and 18*a* are similar to the corresponding components illustrated in FIGS. 1 to 3.

When the bucket lies on the sea bottom, it is subjected, as indicated above, to the action resulting from the movement of the dredging line and from the passage of the dredging ships. The link 11 is pushed through the sediment and cuts out of it a superficial slice. The flexible elements 10, because of their inclination, pick up the nodules laying on and in this superficial slice; because of their structure they screen the sediments without tamping occuring. Because of the inclination and the structure of the flexible elements, the nodules proceed towards the basket where they are stored.

If a forward rocking torque happens, the shape of the shoes and particularly the presence of inclined parts 7 almost always prevents the overturning of the basket.

Thus, a dredging bucket according to the present invention has good stability and remains, during the complete nodule collecting stage, in permanent contact with the sea bottom. In addition, any tamping does not occur in front of the grill. Moreover, the screening between nodules and sediment is very satisfactory.

On the other hand, it is to be noticed that in order to recover the maximum amount of the nodules, and since the pile of collected nodules only partially moves towards the rear of the basket it may be advantageous to extend the inclined grill 5 sufficiently far under the sediment; thus, at the time when it is raised, the bucket collects some nodules which would not be otherwise collected. In the same way, the volume of the basket extends laterally and downwardly inside the shoes. It is to be noticed also that, at the time of its raising, the bucket moves and finds a more or less vertical position, in such a way that the whole of the collected nodules moves and are gathered together in the bottom of the basket.

There are listed below the measurements of a prototype bucket which has worked wholly satisfactorily:

total length: 250 cm
total length of the basket (1): 140 cm
grill (5) length: 70 cm
total width: 200 cm
width of each shoe: 50 cm
total height: 79 cm
vertical distance between the basket floor and the shoe sole: 10 cm
angle of inclination of the grill (5): 20°
angle of inclination of the inclined part (7) of the shoes: 10°

What we claim is:

1. A bucket for dredging the sea bottom in order to collect nodules, comprising a box-like parallel-sided basket open at the front, the basket having a bottom wall with front and rear cross-bars and a plurality of parallel spaced rods extending longitudinally of the basket between said front and rear cross-bars, said bottom wall embodying at its front part a grill with a transverse front link and a plurality of longitudinal spaced flexible elements which are inclined downwardly towards the front and stretched between said front cross-bar and the transverse front link; and large shoes vertically spaced from said front and rear cross-bars of said bottom wall and positioned underneath each lateral side of said basket and having soles with generally horizontal planar surfaces for supporting the bucket on the sea bottom, said grill being situated between said shoes with said transverse front link being positioned in such manner that it extends below said soles and penetrates the sea bottom, said basket extending to external edges of said shoes; and means for hooking said bucket to a dredging line fitted on said shoes.

2. A bucket according to claim 1, further comprising elements fixed to corresponding lateral faces of said basket, said transverse front link being a deformable link having ends anchored to said elements.

3. A bucket according to claim 1, further comprising vertically-extending cheeks having slots formed therein and being placed on both sides of said grill and fixed to said basket, with said slots positioned below said soles to receive therethrough said transverse front link and elements fixed to corresponding side walls of the basket, said transverse front link being a deformable link having ends anchored to said elements.

4. A bucket according to claim 1, wherein said soles extend under the basket essentially along its whole length and are turned up at the front so as to form inclined planes that are prolonged by upwardly rounded portions, and wherein the basket comprises a top wall having a grill identical to the grill of said bottom wall and the upwardly rounded portions of said shoes are prolonged backwards by soles similar to those extending under the basket.

5. A bucket according to claim 1, wherein said flexible elements are fixed at one end of said transverse front link, pass over said front cross-bar and, at their other end, are mounted by means of stretchers on said rear cross-bar.

6. A bucket according to claim 1, wherein said flexible elements are made of steel wire.

7. A bucket according to claim 1, wherein said transverse front link is a deformable link, each end of which is anchored on an element fixed to the corresponding lateral face of the basket.

8. A bucket according to claim 1, wherein said grill is inclined downwardly at an angle of between 10 and 25 degrees.

9. A bucket according to claim 1, wherein said grill is inclined downwardly at an angle close to 20 degrees.

10. A bucket according to claim 1, wherein each of said shoes is comprised of a continuous structure surrounding the corresponding side wall of said basket, said structure comprising a sole which is extended under the basket essentially along its whole length, and which is turned up at the front so as to form an inclined plane and which is prolonged by an upwardly rounded portion, said portion being itself prolonged backwards, over said basket and behind it, by elements joined to the back part of the sole.

11. A bucket according to claim 10, wherein the inclined plane makes an angle of between 5 and 20 degrees with the horizontal.

12. A bucket according to claim 11, wherein said angle is close to 10 degrees.

13. A bucket according to claim 1, wherein the bottom wall of the basket is placed at a vertical distance of about ten centimeters above the sole of said shoes.

14. A bucket according to claim 1, wherein the width of said basket is greater than its length.

15. A bucket according to claim 1, wherein the front of each shoe is fitted with a laterally deflecting plate which is obliquely mounted so as to converge towards the front of the bucket.

16. A bucket for dredging the sea bottom in order to collect nodules, comprising a box-like basket having parallel lateral walls and being open at the front; large shoes attached on each lateral wall side of said basket which are composed of a continuous structure surrounding each lateral wall of said basket, each of said structures comprising a sole defining a plane which is extended under the basket essentially along its whole length, the sole being turned up at the front so as to form an inclined plane that is prolonged backwards over said basket and behind it by elements joined to a back part of the sole; the bottom wall of said basket comprising front and rear cross-bars and a plurality of parallel spaced rods extending longitudinally of the basket between said front and rear cross-bars, said bottom wall embodying at its front part a grill with a plurality of longitudinal spaced flexible elements which are downwardly inclined towards the front of the basket and stretched between said front cross-bar and a transverse front link, said transverse front link being deformable; elements fixed to corresponding lateral faces of said basket for anchoring ends of said transverse front link and; cheeks having slots formed therein, and being fixed to the basket, said transverse front link passing through said slots in such manner that said link is situated under the plane determined by said soles of said shoes.

* * * * *